US012320200B2

(12) United States Patent
Fulks

(10) Patent No.: US 12,320,200 B2
(45) Date of Patent: Jun. 3, 2025

(54) TRAVELING PLATE GUIDE SYSTEM

(71) Applicant: Consolidated Rig Works, L.P., Fort Worth, TX (US)

(72) Inventor: Caleb E. M. Fulks, McKinney, TX (US)

(73) Assignee: Consolidated Rig Works, L.P., Fort Worth, TX (US)

( * ) Notice: Subject to any disclaimer, the term of this patent is extended or adjusted under 35 U.S.C. 154(b) by 74 days.

(21) Appl. No.: 18/448,215

(22) Filed: Aug. 11, 2023

(65) Prior Publication Data

US 2025/0052118 A1 Feb. 13, 2025

(51) Int. Cl.
*E21B 15/00* (2006.01)

(52) U.S. Cl.
CPC ..... *E21B 15/00* (2013.01)

(58) Field of Classification Search
CPC ..... E21B 15/00; E21B 19/00
See application file for complete search history.

(56) References Cited

U.S. PATENT DOCUMENTS 3,498,586 A * 3/1970 Turner, Jr. ..... E21B 19/143 294/90
3,826,472 A * 7/1974 Woolslayer ..... E21B 19/04 52/651.05
4,878,546 A * 11/1989 Shaw ..... E21B 19/08 173/147
2011/0203820 A1* 8/2011 Marica ..... E21B 19/24 104/118
2012/0318530 A1* 12/2012 Wollum ..... E21B 19/22 166/85.4
2019/0093431 A1* 3/2019 Mastell ..... E21B 7/008

* cited by examiner

*Primary Examiner* — Matthew R Buck

(57) ABSTRACT

A traveling plate guide system includes a pair of guide rails, each of the pair of guide rails defining a hollow interior and a slot on one side thereof. The pair of guide rails is interconnected via a plurality of crossmembers. A pair of trolley assemblies each fit within one of the pair of guide rails. Each of the trolley assemblies has a flange that extends out of the slot on an associated guide rail. A traveling plate mounting bracket interconnects the flange of each of the pair of trolley assemblies with a traveling plate for mounting a rotary of a snubbing system. The pair of trolley assemblies moves up and down the pair of guide rails responsive to movement of the traveling plate connected to the traveling plate mounting bracket.

17 Claims, 7 Drawing Sheets

TRAVELING PLATE GUIDE SYSTEM

TECHNICAL FIELD

The present invention relates to snubbing jack and hydraulic work over assemblies, and more particularly to a traveling plate guide system for use with snubbing jack assemblies.

BACKGROUND

A snubbing jack assembly is an apparatus having multiple hydraulically operated piston cylinder assemblies configured to lift a string of tubular members from a wellbore and to push the string down into the wellbore, as may be required by downhole fluid pressure or friction in the wellbore. When adding a tubular member, such as a joint of pipe, to a string of tubular members that extend into a wellbore, the string is held against gravity by slip bowls located within the snubbing jack assembly, and the additional tubular member is positioned above the string by a hoist. The process of "breaking out" a threaded connection to remove a tubular member from the string is similarly performed, in reverse to the process of providing a connection of a new tubular member.

In a conventional arrangement, a rotary drive that rotates the tubular string in the well is mounted to the traveling plate of the snubbing jack assembly and slip bowls are mounted to the hub of the rotary drive. In this way, the tubular string can be rotated while it is supported by the slip bowls, and it can simultaneously be moved in or out of the wellbore by the jacking cylinders which support the traveling plate. The torque from the rotary drive is reacted through the jacking cylinders in this conventional arrangement. To support or react against large perpendicular loads, conventional jacking cylinders have tended to be complicated, expensive and require specialized design features. Thus, the powered rotary adversely affects the lifespan of the hydraulic jacking cylinders that enable movement of the traveling plate during snubbing operations. In order to limit these adverse effects operators are typically forced to reduce their jack stroke to one half of the total jack stroke within the jacking cylinder when using the rotary to reduce the possibility of damaging the hydraulic jacking cylinders. Thus, an improved means for guiding the traveling plate that limits the application of torque to the hydraulic jacking cylinders would be of great benefit within the drilling industry.

SUMMARY

The present invention, as disclosed and described herein, comprises a traveling plate guide system includes a pair of guide rails, each of the pair of guide rails defining a hollow interior and a slot on one side thereof. The pair of guide rails is interconnected via a plurality of crossmembers. A pair of trolley assemblies each fit within one of the pair of guide rails. Each of the trolley assemblies has a flange that extends out of the slot on an associated guide rail. A traveling plate mounting bracket interconnects the flange of each of the pair of trolley assemblies with a traveling plate for mounting a rotary of a snubbing system. The pair of trolley assemblies moves up and down the pair of guide rails responsive to movement of the traveling plate connected to the traveling plate mounting bracket.

BRIEF DESCRIPTION OF THE DRAWINGS

For a more complete understanding, reference is now made to the following description taken in conjunction with the accompanying Drawings in which.

DETAILED DESCRIPTION

Figure 1:
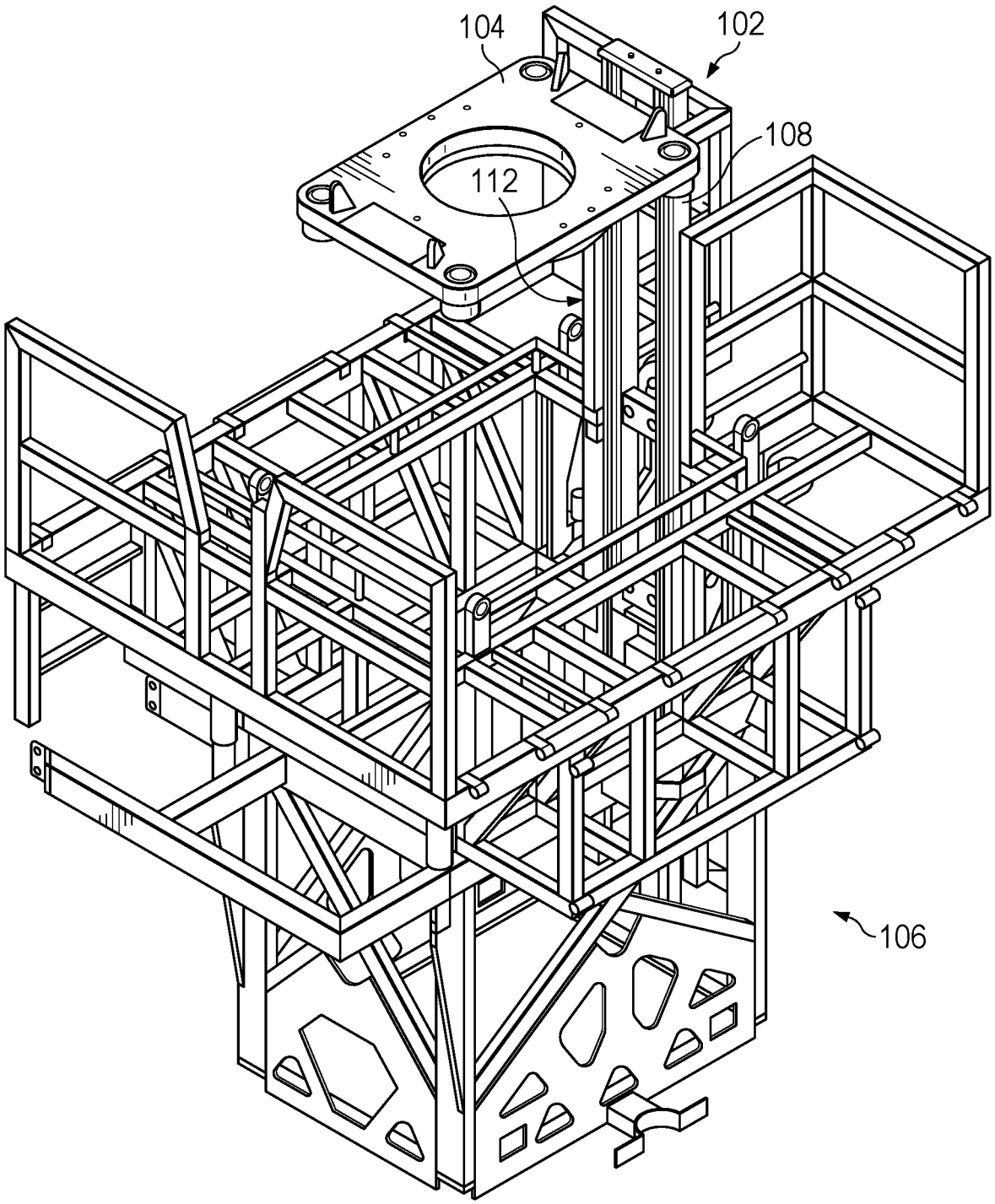
FIG. 1 illustrates a traveling plate and associated guide system within a snubbing assembly framework.

Referring now to the drawings, wherein like reference numbers are used herein to designate like elements throughout, the various views and embodiments of a traveling plate guide system are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Referring now to the drawings, and more particularly to FIG. 1, there is illustrated the traveling plate guide system 102 for enabling a traveling plate 104 to move up and down along a tubular string within a snubbing unit frame 106. A traveling plate 104 is connected to a rotary (not shown) of a snub drilling system in order to enable the rotary to be moved up and down along a tubular string for drill section removal or addition processes. The traveling plate 104 is supported by four hydraulic jacking cylinders (not shown) that are connected to the bottom side of each corner of the traveling plate 104 and enable the traveling plate to move the string of tubulars up and down. In practice, hydraulic jacking cylinders are located at each of the corners of the traveling plate.

The traveling plate 104 is supported to resist torque reactions from the rotary by a trolley assembly 216 (FIG. 2) that moves up and down along a pair of guide rails 112 connected to the snubbing unit frame 106. The trolley assembly 216 is operably connected to the traveling plate 104 and rolls up and down the guide rails 112 as the traveling plate 104 is raised and lowered by the hydraulic jacking cylinders 108. Connection of the traveling plate 104 to the traveling plate guide system 102 will limit the torque that is transmitted to the hydraulic jacking cylinders (not shown) that is caused when a rotary (not shown) connected to the traveling plate 104 is rotating. This will prevent the operator from needing to reduce the jack stroke of the hydraulic jacking cylinders when using the rotary in order to reduce the possibility of damaging the hydraulic jack cylinders. In the illustrated embodiment, the connection between the traveling plate 104 and the trolley assembly 216 is a rigid connection in the plane of the traveling plate, but is a pivoting connection between the plane of the traveling plate 104 and the plane of the guide rails 112, i.e., to allow the angle between the traveling plate 104 and the guide rails 112 to vary such that the guide rails will not be damaged if the plane of the traveling plate 104 does not remain exactly perpendicular to the plane of the guide rails 112 during hydraulic jacking operations.

Figure 2:
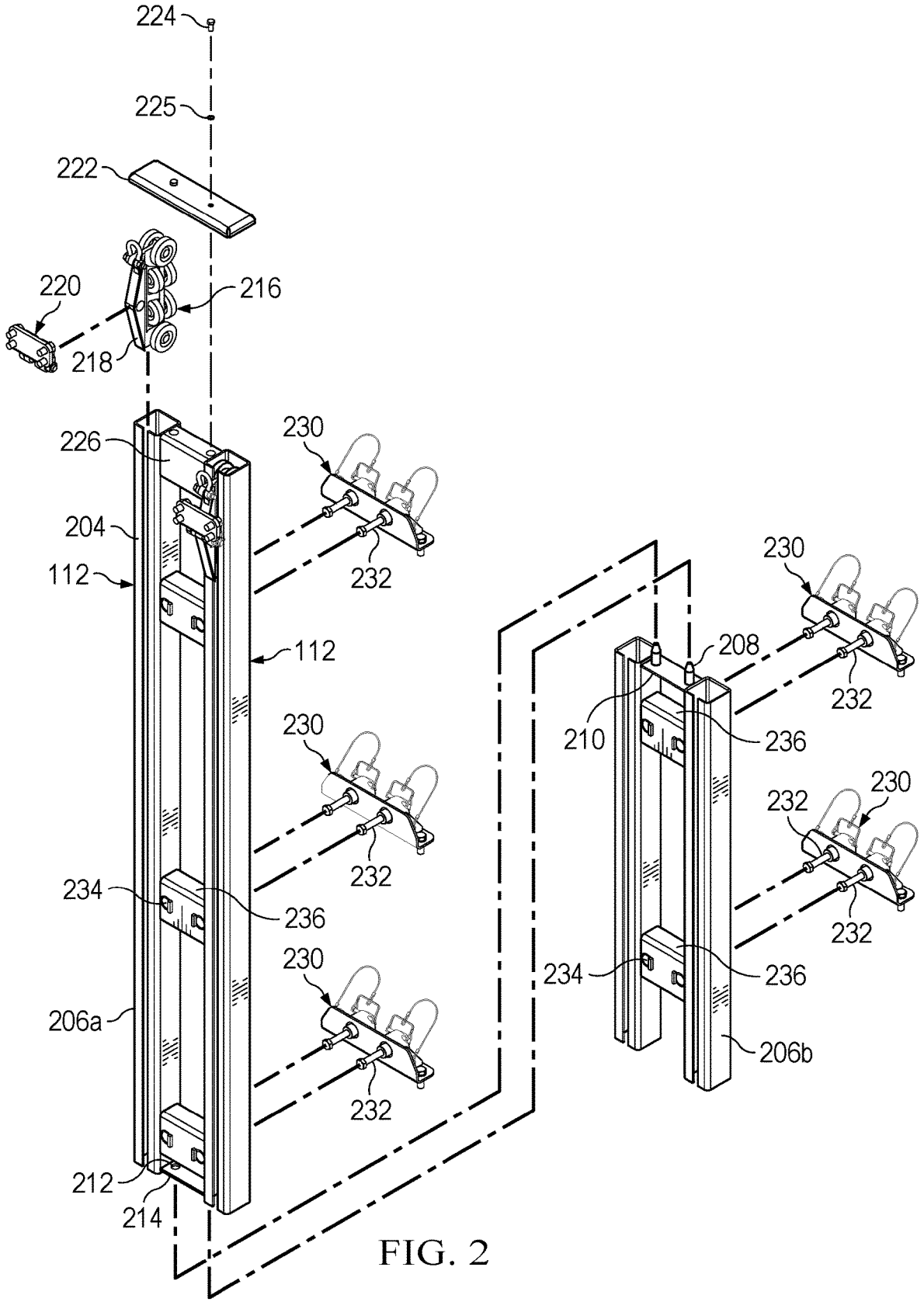
FIG. 2 illustrates an exploded perspective view of the guide rail system and assembly brackets for the traveling plate guide system.

Referring now to FIG. 2, there is more particularly illustrated an exploded perspective view of the traveling plate guide system 102. The traveling plate guide system 102 includes a pair of guide rails 112 that are substantially square in cross section and define a hollow interior therein into which the trolley assembly 216 may be inserted. The guide rails 112 further define a slot 204 on one side thereof. The guide rails 112 are divided into a plurality of sections 206 that are interconnectable. The illustration in FIG. 2 illustrates an upper section 206*a* and a lower section 206*b*, but any number of sections may be used. The guide rail sections 206 are interconnected via pins 208 mounted on crosspiece 210 at the top of a guide rail section 206*b* that interconnect with an upper guide rail section 206*b* by inserting through holes 212 within a second crosspiece member 214 on an adjacent guide rail section 206*a*. This separation facilitates disassembly of the snubbing unit for transport.

A trolley assembly 216, as will be more fully discussed hereinbelow, is inserted within each of the pair of guide rails 112. A pivot flange 218 of the trolley assembly 216 extends laterally from the trolley assembly and passes through the slot 204 within the guide rails 112. A travel plate mounting bracket 220 mounts to the pivot flange 218 and enables the trolley assembly 216 to be interconnected with the traveling plate 104. After the trolley assemblies 216 are inserted into each of the guide rails 112, a rail cap plate 222 is secured to the top of the guide rail section 206*a* using a bolt 224 and lock washer 225 to secure the rail cap plate 222 to a crossmember 226 between the guide rails 112.

The guide rails 112 are interconnected with the snubbing unit frame 106 via a plurality of adjustable brackets 230. Each of the adjustable brackets 230 include a pair of pins 232 that inserted through holes 234 located within cross members 236 interconnecting the guide rails 112. The pins 232 are secured to the cross members 236 via some type of securing means. As will be more fully described hereinbelow, the adjustable brackets 230 include a number of adjustment features that may be performed thereon to enable the connection of the guide rails 112 to the snubbing unit frame 106 to be adjusted to suit configuration requirements of the snubbing unit frame. For example, each bracket can include a first portion (e.g., pin 232) connectable to the guide rails 112 and a second portion (e.g., plate 406) connectable to the snubbing unit frame 106, and preferably includes a first adjustment mechanism (e.g., nuts 411) to change the bracket position relative to the guide rails 112 along a front-to-back axis and a second adjustment mechanism (e.g., eccentric bushing 416) to change the bracket position relative to the snubbing unit frame 106 along a side-to-side axis, together allowing the guide rails 112 to be positioned in a very straight arrangement even if the snubbing unit frame 106 to which the guide rails are attached is not precisely straight.

Figure 3:
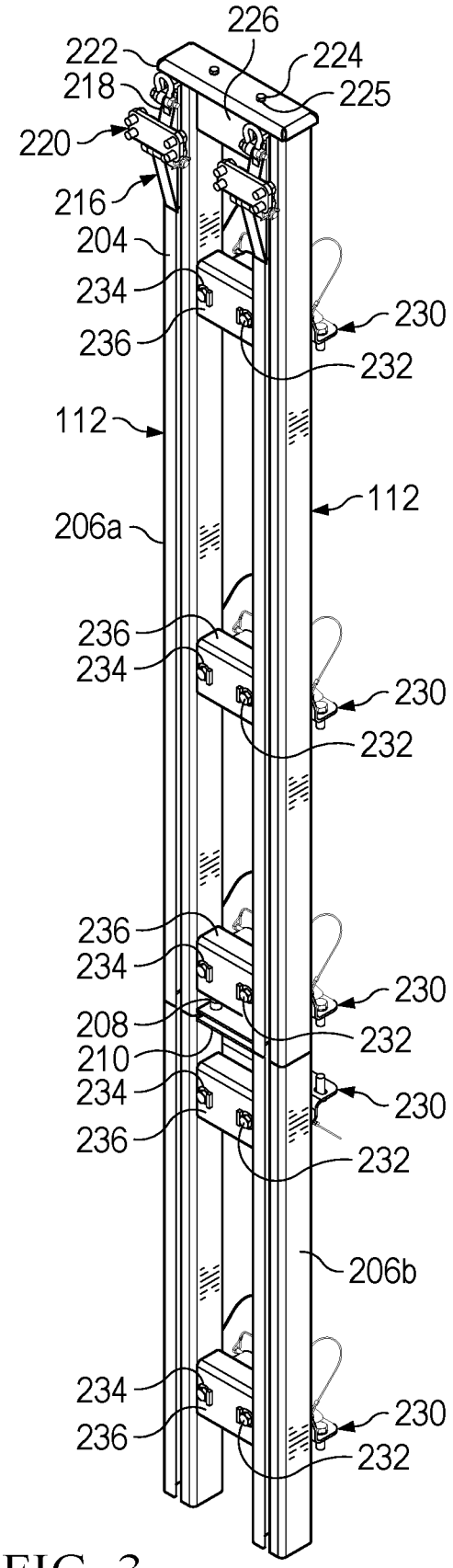
FIG. 3 illustrates a perspective view of the guide rails for the traveling plate guide system.

Referring now to FIG. 3, there is illustrated a perspective view of the guide rail system 102 in an assembled configuration with each of the plurality of guide rail portions 206 interconnected with each other. The trolley assemblies 216 are also inserted within the guide rails 112 and the various adjustable brackets 232, cap plate 222 and travel plate mounting bracket 220 are interconnected with the guide rails 112.

Figure 4:
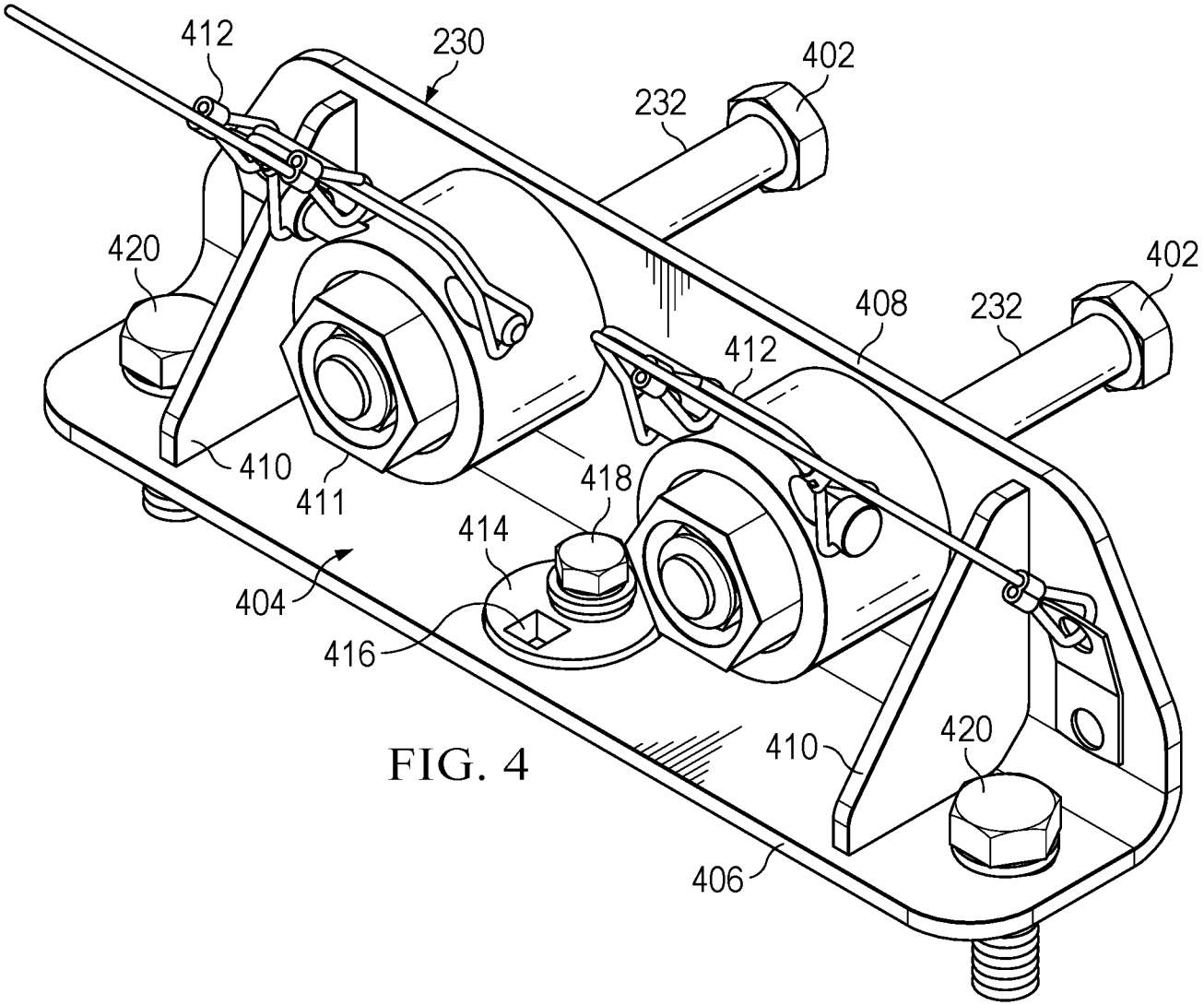
FIG. 4 illustrates a perspective view of the adjustable bracket for interconnecting the guide rails for the traveling plate guide system.

Referring now to FIG. 4, there is more particularly illustrated the adjustable mounting bracket 230 used for mounting the guide rails 112 to the snubbing unit frame 106. As mentioned previously, a pair of pins 232 extend through corresponding holes 234 within a crossmember 236 of the guide rails 112. The mounting bracket 230 is secured to the crossmember 236 using a pair of hexagonal nuts 402 that threadedly engage the pins 232. The adjustable mounting bracket 230 includes a main L-shaped portion 404 that includes a horizontal plate 406 that connects with a lateral plate 408 at approximately a 90° angle. A pair of supporting arms 410 provide additional structural support between the horizontal plate 406 and the vertical plate 408. An adjustable mechanism such as adjustable threaded nuts 411 enables the pins 232 to be shifted back and forth along a front-to-back axis in the horizontal direction after connection to the guide rails 112. This enables the pins 232 to be moved laterally in the front-to-back direction in order to avoid structures within the snubbing unit framework 106 and facilitate straight mounting of the guide rails 112 to the snubbing unit framework. Removable safety pins 412 can be provided to selectively secure the adjustable threaded nuts 411 in place after adjustment. The adjustment mounting bracket 404 may be adjusted laterally in its position using an eccentric capture bushing 414. The eccentric capture bushing 414 enables insertion of a tool within opening 416 to rotate the bushing in order to move the adjustable bracket laterally to the left and right. The eccentric capture bushing 414 rotates about a bolt 418. Bolts 420 may further be used for securing in the adjustable mounting bracket 404 to the snubbing unit framework 106.

Figure 5:
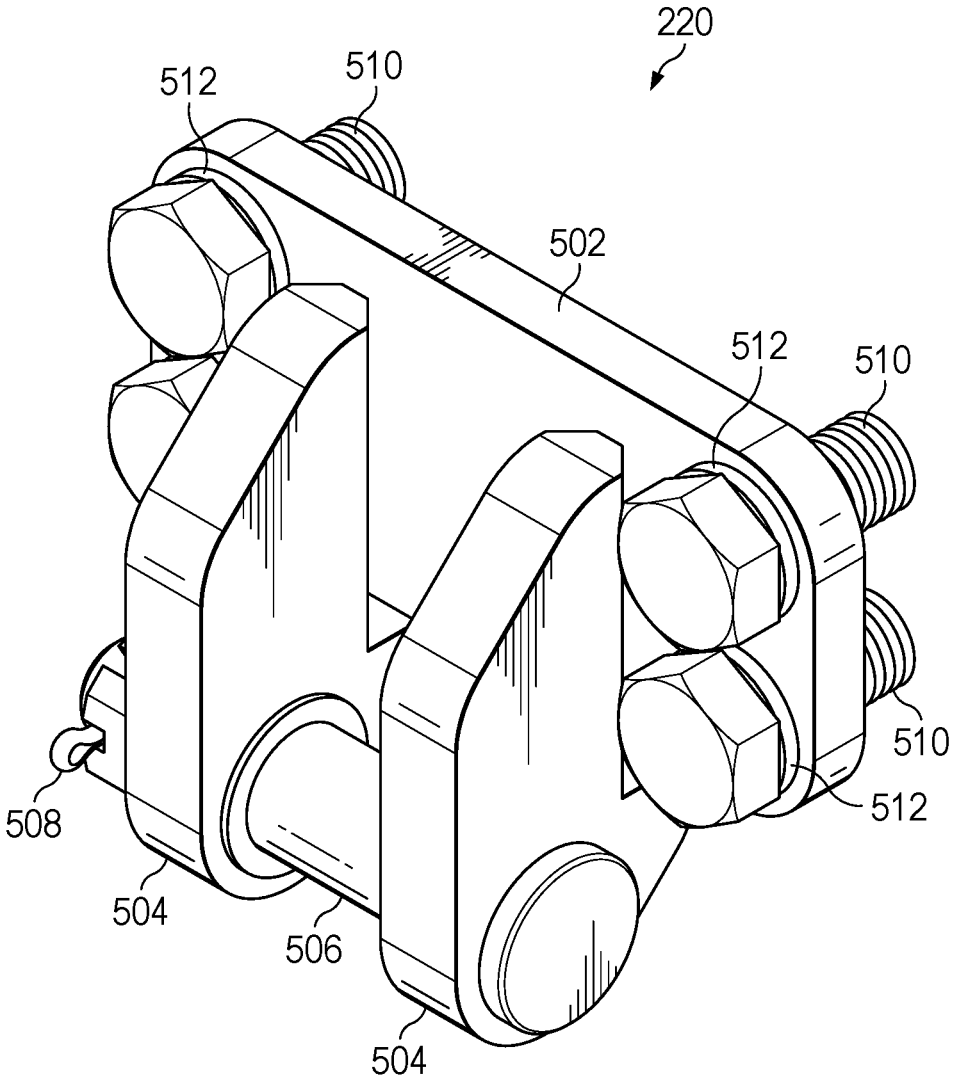
FIG. 5 illustrates the traveling plate mounting bracket for the traveling plate guide system.

Referring now to FIG. 5, there is illustrated the travel plate mounting bracket 220. The travel plate mounting bracket 220 includes a mounting plate 502 including a pair of support members 504 that extends perpendicularly from a backside thereof. Support members 504 connect to a backside and a bottom edge of the mounting plate 502 and define an opening therein for receiving a support pin 506. The support pin 506 inserts through the holes defined within the support members 504 and a corresponding hole 610 within the trolley assembly 216 as will be more fully described hereinbelow. The support pin 506 is held in place by a nut and cotter pin 508. The mounting plate 502 defines an opening at each corner thereof for receiving a bolt 510. The bolt 510 is inserted through the opening and threaded the engages the traveling plate 104. The bolts 510 are prevented from loosening by lock washers 512.

Figure 6:
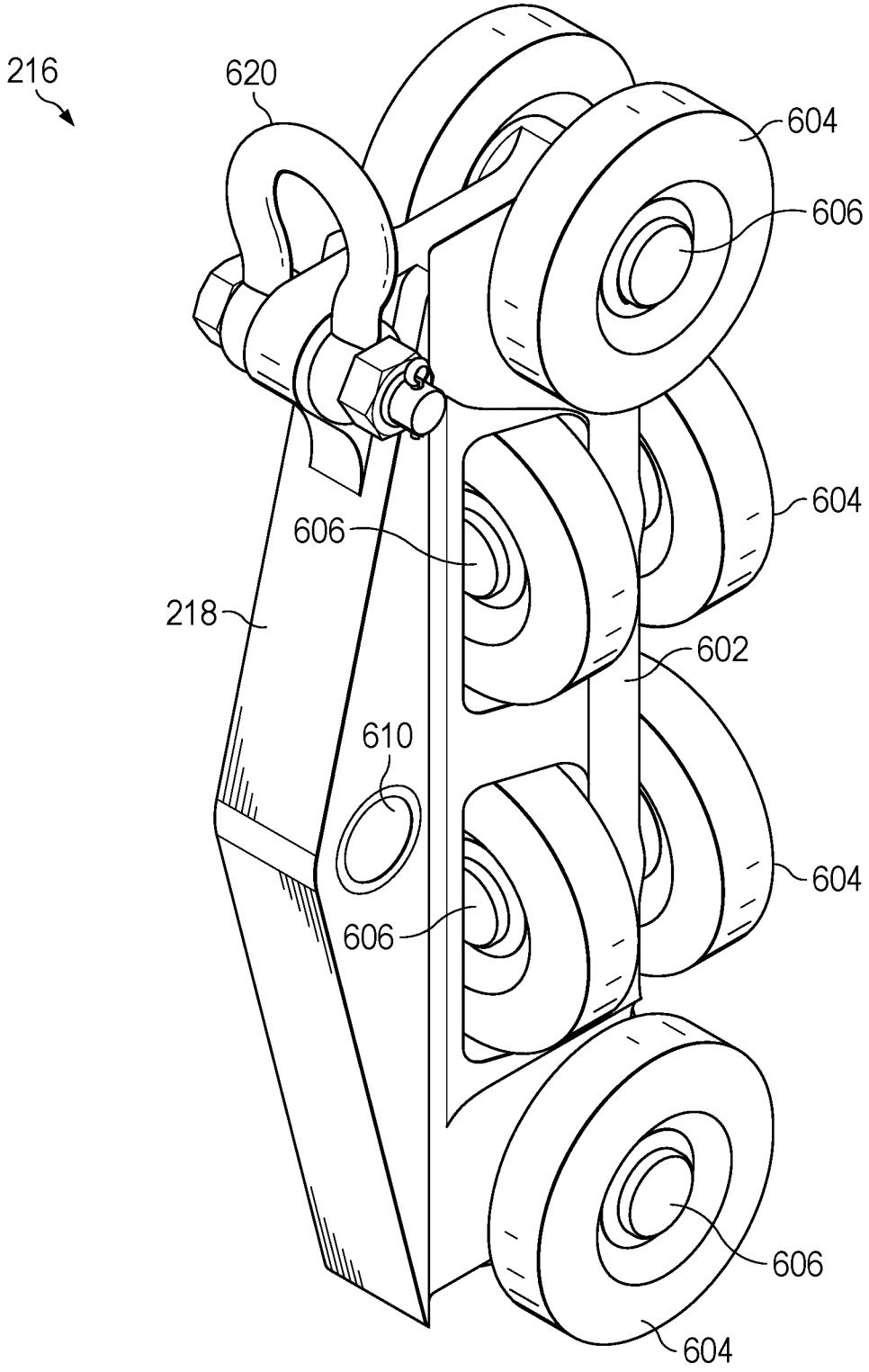
FIG. 6 illustrates a perspective view of the trolley guides for interfacing the traveling plate with the guide rails for the traveling plate guide system.

Referring now to FIG. 6, there is illustrated an enlarged perspective view of the trolley assembly 216. The trolley assembly 216 includes a main support bracket 602 upon which a plurality of rollers 604 are mounted. Each of the rollers 604 are mounted upon an axle 606 which passes through the main support bracket 602. Each of the rollers 604 further includes a bearing to enable case of rolling of the roller 604 about the axle 606. Each axle 606 supports two rollers 604. The main support bracket 602 includes the pivot flange 218 that inserts through the corresponding slot 204 within the guide rail 112 and connects with the mounting bracket 220. A hole 610 defined within the pivot flange 218 receives the support pin 506 of the mounting bracket 220. The pivoting connection between the pivot flange 218 of the trolley assembly 216 and the mounting bracket 220 connected to the traveling plate 104 allows the assembly to pivot to accommodate slanting of the travel plat 104 relative to the guide rails 112 while still resisting the torque received from the rotary. The pivot flange 218 further is inserted between the support members 504 of the mounting bracket 220 to enable hole 610 defined within the flange to align with the corresponding holes defined within the support members 504. The rollers 604 are associated in pairs on a single axle 606. Each alternating pair of rollers 604 has its axle 606 perpendicular to the adjacent axle such that the direction of rolling of the rollers 604 alternate between each pair of rollers. Thus, first and second pair of rollers will roll along a first pair of opposite sides within the rectangular guide rails 112 and third and fourth pairs of rollers 604 will roll along a second pair of opposite sides of the rectangular guide rails 112. A shackle assembly 620 is used for installation of the trolley assembly 216 into the rail assembly 112. The rollers 604 may comprise nylon wheels in one embodiment.

Figure 7:
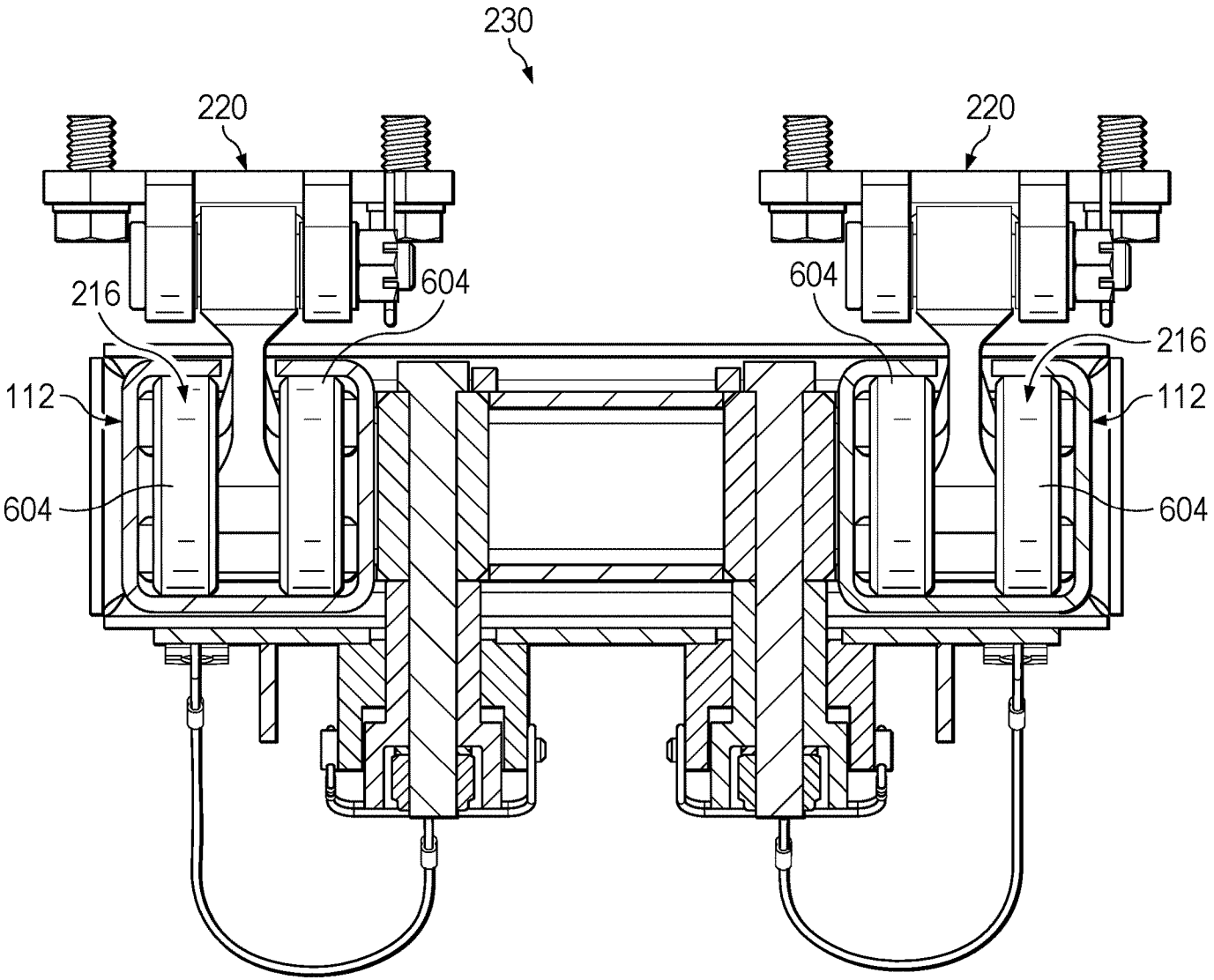
FIG. 7 illustrates a cross-sectional view of the trolley guides and guide rails for the traveling plate guide system.

Referring now to FIG. 7, there is illustrated a cross-sectional view of the guide rails 112 roller assembly 216 and mounting bracket 230. As can be seen, the roller assemblies 216 fit within the guide rails 112 and the rollers 604 roll along opposite walls on the interior of the guide rail 112. The pivot flange 218 extends through the slot 204 within the guide rail 112 and is used for interconnecting the roller assembly to the mounting bracket 220. The adjustable mounting bracket 230 is secured to the guide rails 112.

It will be appreciated by those skilled in the art having the benefit of this disclosure that this traveling plate guide system provides a traveling plate guide system that limits torque applied to the hydraulic jacking cylinders. It should be understood that the drawings and detailed description herein are to be regarded in an illustrative rather than a restrictive manner and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A traveling plate guide system, comprising:

a pair of guide rails, each of the pair of guide rails defining a hollow interior and a slot on one side thereof, the pair of rails interconnected via a plurality of crossmembers;

a pair of trolley assemblies that each fit within one of the pair of guide rails, each of the trolley assemblies having a flange that extends out of the slot on an associated guide rail, wherein each of the pair of trolley assemblies further comprise:

a trolley frame, the trolley frame including the flange extending outward therefrom defining a hole therein;

a first plurality of wheel pairs having a first axis of rotation; and a second plurality of wheel pairs having a second axis of rotation that is perpendicular to the first axis of rotation;

a traveling plate mounting bracket for interconnecting the flange of each of the pair of trolley assemblies with a traveling plate for mounting a rotary of a snubbing system; and wherein the pair of trolley assemblies move up and down the pair of guide rails responsive to movement of the traveling plate connected to the traveling plate mounting bracket.

2. The traveling plate guide system of claim 1, wherein the first plurality of wheel pairs and the second plurality of wheel pairs comprise nylon wheels.

3. A traveling plate guide system, comprising:

a pair of guide rails, each of the pair of guide rails defining a hollow interior and a slot on one side thereof, the pair of rails interconnected via a plurality of crossmembers;

a pair of trolley assemblies that each fit within one of the pair of guide rails, each of the trolley assemblies having a flange that extends out of the slot on an associated guide rail;

a traveling plate mounting bracket for interconnecting the flange of each of the pair of trolley assemblies with a traveling plate for mounting a rotary of a snubbing system, wherein the traveling plate mounting bracket further comprises:

a mounting plate defining a plurality of mounting bolt holes therein;

a plurality of mounting bolts that each extend through the mounting bolt holes to secure the traveling plate to the mounting plate; and a least two support members extending perpendicularly from a backside of the mounting plate and defining a hole for receiving a support pin for interconnecting the traveling plate mounting bracket to the flange of the trolley assemblies; and wherein the pair of trolley assemblies move up and down the pair of guide rails responsive to movement of the traveling plate connected to the traveling plate mounting bracket.

4. A traveling plate guide system, comprising:

a pair of guide rails, each of the pair of guide rails defining a hollow interior and a slot on one side thereof, the pair of rails interconnected via a plurality of crossmembers. the pair of guide rails further comprise a plurality of interconnectable sections, wherein the pair of guide rails further comprises:

a pair of pins extending from a first crossmember interconnecting the pair of guide rails;

a pair of holes defined within a second crossmember interconnecting the pair of guide rails; and wherein the pair of pins in the first crossmember are inserted into the pair of holes defined in the second crossmember to interconnect a first interconnectable section of the pair of guide rails section with a second interconnectable section of the pair of guide rails;

a pair of trolley assemblies that each fit within one of the pair of guide rails, each of the trolley assemblies having a flange that extends out of the slot on an associated guide rail;

a traveling plate mounting bracket for interconnecting the flange of each of the pair of trolley assemblies with a traveling plate for mounting a rotary of a snubbing system; and wherein the pair of trolley assemblies move up and down the pair of guide rails responsive to movement of the traveling plate connected to the traveling plate mounting bracket.

5. A traveling plate guide system comprising:

a pair of guide rails, each of the pair of guide rails defining a hollow interior and a slot on one side thereof, the pair of rails interconnected via a plurality of crossmembers;

a pair of trolley assemblies that each fit within one of the pair of guide rails, each of the trolley assemblies having a flange that extends out of the slot on an associated guide rail;

a traveling plate mounting bracket for interconnecting the flange of each of the pair of trolley assemblies with a traveling plate for mounting a rotary of a snubbing system;

wherein the pair of trolley assemblies move up and down the pair of guide rails responsive to movement of the traveling plate connected to the traveling plate mounting bracket;

a plurality of adjustable mounting brackets for connecting the pair of guide rails to a structure of a snubbing unit; and at least one adjustable connector included on each of the plurality of adjustable mounting brackets that may be moved to a location within an adjustable mounting bracket that does not interfere with the structure of the snubbing unit.

6. A traveling plate guide system comprising a pair of guide rails, each of the pair of guide rails defining a hollow interior and a slot on one side thereof, the pair of rails interconnected via a plurality of crossmembers;

a pair of trolley assemblies that each fit within one of the pair of guide rails, each of the trolley assemblies having a flange that extends out of the slot on an associated guide rail;

a traveling plate mounting bracket for interconnecting the flange of each of the pair of trolley assemblies with a traveling plate for mounting a rotary of a snubbing system;

wherein the pair of trolley assemblies move up and down the pair of guide rails responsive to movement of the traveling plate connected to the traveling plate mounting bracket; and a plurality of adjustable mounting brackets enabling the pair of guide rails to be installed parallel to a jack cylinder stroke direction.

7. A traveling plate guide system, comprising:

a pair of guide rails, each of the pair of guide rails defining a hollow interior and a slot on one side thereof, the pair of rails interconnected via a plurality of crossmembers, the pair of guide rails comprising a plurality of interconnectable assemblies, wherein each of the plurality of interconnectable assemblies further includes:

a pair of pins extending from a first crossmember interconnecting the pair of guide rails;

a pair of holes defined within a second crossmember interconnecting the pair of guide rails; and wherein the pair of pins in the first crossmember are inserted into the pair of holes defined in the second crossmember to interconnect a first interconnectable section of the pair of guide rails with a second interconnectable section of the pair of guide rails;

a pair of trolley assemblies that each fit within one of the pair of guide rails, each of the trolley assemblies having a flange that extends out of the slot on an associated guide rail, wherein each of the pair of trolley assemblies further comprises:

a trolley frame, the trolley frame including the flange extending outward therefrom defining a hole therein;

a first plurality of wheel pairs having a first axis of rotation; and a second plurality of wheel pairs having a second axis of rotation that is perpendicular to the first axis of rotation;

a traveling plate mounting bracket for interconnecting the flange of each of the pair of trolley assemblies with a traveling plate for mounting a rotary of a snubbing system; and wherein the pair of trolley assemblies move up and down the pair of guide rails responsive to movement of the traveling plate connected to the traveling plate mounting bracket.

8. The traveling plate guide system of claim 7, wherein the first plurality of wheel pairs and the second plurality of wheel pairs comprise nylon wheels.

9. The traveling plate guide system of claim 7, wherein the traveling plate mounting bracket further comprises:

a mounting plate defining a plurality of mounting bolt holes therein;

a plurality of mounting bolts that each extend through the mounting bolt holes to secure the traveling plate to the mounting plate; and at least two support members extending perpendicularly from a backside of the mounting plate and defining a hole for receiving a support pin for interconnecting the traveling plate mounting bracket to the flange of the trolley assemblies.

10. The traveling plate guide system of claim 7 further comprising:

a plurality of adjustable mounting brackets for connecting the pair of guide rails to a structure of a work over rig; and at least one adjustable connector included on each of the plurality of adjustable mounting brackets that may be moved to a location within an adjustable mounting bracket that does not interfere with the structure of the work over rig.

11. The traveling plate guide system of claim 7 further comprising a plurality of adjustable mounting brackets enabling the pair of guide rails to be installed parallel to a jack cylinder stroke direction.

12. A traveling plate guide system, comprising:

a pair of substantially rectangular guide rails having first and second pairs opposing side walls, each of the pair of guide rails defining a hollow interior and a slot in one of the side walls, the pair of rails interconnected via a plurality of crossmembers;

a pair of trolley assemblies that each fit within one of the pair of guide rails, each of the trolley assemblies further comprising:

a flange that extends out of the slot in the side wall of an associated guide rail;

a first set of wheels that rotate in a first plane between the second pair of opposing side walls;

a second set of wheels that rotate in a second plane perpendicular to the first plane between the second pair of opposing side walls;

a traveling plate mounting bracket for interconnecting the flange of each of the pair of trolley assemblies with a traveling plate for mounting a rotary of a snubbing system; and wherein the pair of trolley assemblies move up and down the pair of guide rails responsive to movement of the traveling plate connected to the traveling plate mounting bracket.

13. The traveling plate guide system of claim 12, wherein the first set of wheels and the second set of wheels comprise nylon wheels.

14. The traveling plate guide system of claim 12, wherein the traveling plate mounting bracket further comprises:

a mounting plate defining a plurality of mounting bolt holes therein;

a plurality of mounting bolts that each extend through the mounting bolt holes to secure the traveling plate to the mounting plate; and a least two support members extending perpendicularly from a backside of the mounting plate and defining a hole for receiving a support pin for interconnecting the traveling plate mounting bracket to the flange of the trolley assemblies.

15. The traveling plate guide system of claim 12, wherein the pair of guide rails further comprises:

a pair of pins extending from a first crossmember interconnecting the pair of guide rails;

a pair of holes defined within a second crossmember interconnecting the pair of guide rails; and wherein the pair of pins in the first crossmember are inserted into the pair of holes defined in the second crossmember to interconnect a first interconnectable section of the pair of guide rails with a second interconnectable section of the pair of guide rails.

16. The traveling plate guide system of claim 12 further comprising:

a plurality of adjustable mounting brackets for connecting the pair of guide rails to a structure of a snubbing unit frame; and at least one adjustable connector included on each of the plurality of adjustable mounting brackets that may be moved to a location within an adjustable mounting bracket that does not interfere with the structure of the snubbing unit frame.

17. The traveling plate guide system of claim 12 further comprising a plurality of adjustable mounting brackets enabling the pair of guide rails to be installed parallel to a jack cylinder stroke direction.

* * * * *